US005233839A

United States Patent [19]

Greter et al.

[11] Patent Number: 5,233,839

[45] Date of Patent: Aug. 10, 1993

[54] PROCESS FOR OPERATING A HEAT EXCHANGER

[75] Inventors: Lucien Greter, Le Plessis Trevise; François Venet, Paris, both of France

[73] Assignee: L'Air Liquide, Societe Anonyme pour l'Etude et l'Exploitation des Procedes Georges Claude, Paris, France

[21] Appl. No.: 907,707

[22] Filed: Jul. 2, 1992

Related U.S. Application Data

[63] Continuation-in-part of Ser. No. 846,373, Mar. 5, 1992, abandoned.

[30] Foreign Application Priority Data

Mar. 13, 1991 [FR] France ..... 9103012

[51] Int. Cl.[5] ..... F25J 3/00

[52] U.S. Cl. ..... 62/36; 62/40; 165/166

[58] Field of Search ..... 62/36, 40; 165/166, 165/167

[56] References Cited

U.S. PATENT DOCUMENTS

| | | | |
|---|---|---|---|
| 2,552,561 | 5/1951 | Jenny et al. | 62/40 |
| 3,282,334 | 11/1966 | Stahlheber | 62/36 |
| 3,358,460 | 12/1967 | Smith et al. | 62/40 |
| 3,992,168 | 11/1976 | Toyama et al. | 62/36 |
| 4,050,506 | 9/1977 | Small . | |
| 4,486,210 | 12/1984 | Gauthier | 62/40 |
| 4,599,097 | 7/1986 | Petit et al. | 62/36 |
| 5,157,927 | 10/1992 | Darchis et al. | 62/40 |

FOREIGN PATENT DOCUMENTS 1403087 5/1965 France .

OTHER PUBLICATIONS

P. Wicker, Natural Gas Reliquefaction Plant Sulzer Tedi. Rev. (Switzerland) vol. 53, No. 1 (1971).

Chemical Abstracts, vol. 95, No. 9, Nov. 1981, Abstract No. 152976X, K. Sanso, "Temporary Shut Down of Air Liquefaction Apparatus," p. 132.

*Primary Examiner*—John K. Ford

*Attorney, Agent, or Firm*—Curtis, Morris & Safford

[57] ABSTRACT

The invention aims at preventing the risks of deformation and breaking down of the heat exchanger which is part of a plant for the batch treatment of fluids, of the type in which, during active periods which are separated from one another by rest periods, at least one refrigerating fluid is allowed to circulate in first ducts of the exchanger, from the cold end to the hot end of the latter, and at least one calorigenic fluid is circulated in second ducts of the exchanger, from the hot end to the cold end of the latter, characterized in that, during rest periods, heat is introduced at the hot end and cold is introduced at the cold end of the exchanger so as to maintain these two ends at temperatures which are relatively close to those corresponding to the active periods, at least one of these two inputs being supplied by means of a reserve fluid of the plant.

9 Claims, 1 Drawing Sheet

PROCESS FOR OPERATING A HEAT EXCHANGER

This application is a continuation-in-part of application Ser. No. 07/846,373, filed Mar. 5, 1992, now abandoned.

BACKGROUND OF THE INVENTION a) Field of the Invention

The present invention relates to heat exchangers which operate in counter-current and which are used in plants for the batch treatment of fluids.

b) Description of Prior Art

These plants cause particular problems, for the following reasons.

In continuous operation, a heat exchanger operating in counter-current has a temperature curve which is generally linear between its cold end and its hot end.

Since this curve is bound to the temperature of the fluids which pass through the heat exchanger and which exchange heat with one another, any sudden pause of the circulation of these fluids produce a rapid standardisation, by conduction, of the temperatures of the exchanger towards a temperature which is substantially the average of the temperatures from the hot end to the cold end.

The exchanger therefore undergoes rapid variations of temperature at its ends, and a major risk of deformation or breaking down appears when it is restarted, because of the thermic shocks produced by the fluids treated.

For example, in the case of the main heat exchanger of a plant for the distillation of air and the production of nitrogen of the type HPN (High Purity Nitrogen), the air treated at 8 bars enters at +20° C. and is cooled to about −169° C. in counter-current to the products which exit: nitrogen, reheated from −173° C. to +15° C. and the residual gas, reheated from −180° C. to +15°C. In permanent operation, the exchanger has a temperature which varies linearly from about −175° C. at the cold end up to +17° C. at the hot end. If the circulation of fluids is suddenly stopped, the temperature of the exchanger rapidly reaches an equilibrium at about −80°C.

SUMMARY OF INVENTION

The invention aims at preventing the risks of deformation and breaking down of the heat exchanger when the latter is restarted.

For this purpose, it is an object of the invention to provide a process for operating a heat exchanger which is part of a plant for the batch treatment of fluids, of the type in which, during active periods which are separated from one another by rest periods, at least one refrigerating fluid is allowed to circulate in first ducts of the exchanger, from the cold end to the hot end of the latter, and at least one calorigenic fluid is circulated in second ducts of the exchanger, from the hot end to the cold end of the latter, characterized in that, during rest periods, heat is introduced at the hot end and cold is introduced at the cold end of the exchanger so as to maintain these two ends at temperatures which are relatively close to those corresponding to the active periods, at least one of these two inputs being supplied by means of a reserve fluid of the plant.

According to other characteristics:

at the end of each rest period, said quantities of heat and/or cold are progressively increased to progressively bring the temperatures of the two ends of the exchanger to temperatures corresponding to active periods;

during the active periods, when one of the two ends of the exchanger is at a temperature near room temperature, this end of the exchanger is placed in heat exchange relationship with the outside atmosphere during the rest periods;

in the case of a cryogenic plant, the hot end is placed in heat exchange relationship with the outside atmosphere by conduction, and the cold end is placed in heat exchange relationship with evaporations of a reserve cryogenic liquid of the plant;

an additional quantity of heat, is introduced at the hot end during the rest periods, such as by Joule effect;

said evaporations are circulated from the cold end to the hot end of the exchanger, in said second ducts of the latter, or in ducts especially provided for this purpose.

It is also an object of the invention to provide a heat exchanger adapted for the operation of such process. This exchanger, of the type comprising a cold end, a hot end, first ducts extending from the cold end to the hot end for the circulation of a refrigerating fluid, seconds ducts extending from the hot end to the cold end for the circulation of calorigenic fluid, is characterized in that it comprises on the one hand, at a first end, heat conductive supports extending to a source of heat, and on the other hand means to place a reserve fluid of the plant in heat exchange relationship with the other end of the exchanger.

According to other characteristics:

said means comprise ducts of the exchanger especially adapted for the circulation of said reserve fluid, said ducts being connected to a supply of this fluid;

the heat exchanger being of the type including brazed plates, said means comprise a coil mounted in heat exchange relationship on each face of the exchanger including the end plates, this coil being connected to a supply of storage fluid;

the coil defines a heat exchange surface which is more important in the vicinity of said other end of the exchanger;

the heat conductive supports are provided with additional heating means, such as electrical resistances.

BRIEF DESCRIPTION OF DRAWINGS

The embodiments of the invention will now be described with reference to the annexed drawing, in which.

DESCRIPTION OF PREFERRED EMBODIMENTS

Figure 1:
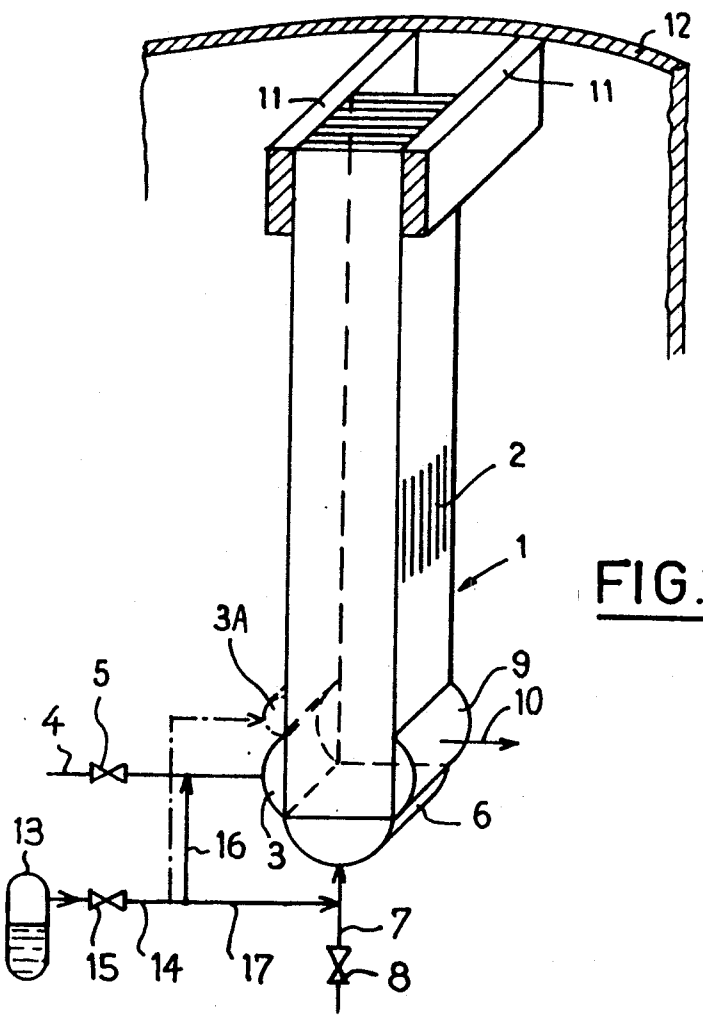
FIG. 1 is a partial schematical perspective view of a heat exchanger according to the invention.

FIG. 1 which only represents the elements which are essential to understanding the invention, shows a counter-current heat exchanger of the type including brazed aluminum plates, which is part of a plant for treating fluids in batch, typically a plant for the distillation of air. More specifically, this example illustrates a plant for the production of nitrogen of the type HPN.

As it is well known, an exchanger with brazed plates consists of a stacking of a plurality of aluminum plates 2, vertically superposed, which are all identical, rectangular and parallel to one another. These plates define therebetween a number of flat ducts. Cross-bars are mounted on the edges of these plates, and suitable interruptions of these bars define windows for the inlet or outlet of fluids in these groups of selected ducts.

The inlets-outlets of fluids are carried out by means of semi-cylindrical boxes disposed against the faces of the exchanger which include bars.

In the example under consideration, the lower end, or cold end, of the exchanger includes three boxes:

on the vertical face of the exchanger, box 3 normally constitutes the inlet of gaseous, refrigerating nitrogen, produced by the plant; this gaseous nitrogen is introduced into box 3 via duct 4 which is provided with a stop valve 5;

on the lower face of the exchanger, a box 6 which is normally used for the inlet of a residual gas, which is also refrigerating, of the plant, which gas is introduced into box 6 via duct 7 provided with a stop valve 8; and on the other vertical face of the exchanger, a box 9 which is used as an outlet for air to be distilled, after cooling, this air constituting the calorigenic fluid of the heat exchanger and comes out of box 9 via duct 10.

The exit of nitrogen and residual gas from the exchanger is carried out by means of respective outlet boxes (not illustrated) provided at the upper end or hot end, of the exchanger; similarly, the inlet for the air to be treated is carried out by means of an inlet box (not illustrated) provided for at this upper end.

In the vicinity of its hot end, the exchanger is mounted on two horizontal supports 11 which extend to an exterior metallic sheath 12 of the plant whose exterior face is in contact with the outside atmosphere. These supports are heat conductive and in order to ensure a good heat exchange, they are in close contact with the respective vertical faces of the exchanger 1 including boxes 3 and 9, along the entire width of these faces.

The air distillation plant comprises a supply of cryogenic liquid, which, for example, is a liquid/vapor phase separator, the bottom of a distillation column or a tank of liquid. This tank has been schematically illustrated at 13, and it will be understood hereinafter that it consists of a tank of liquid nitrogen. A duct 14 provided with a stop valve 15 goes from the upper part of this tank 13. This duct is divided into two ducts 16, 17 respectively ending in boxes 3 and 6.

During the periods of normal operation of the plant, the counter-current circulation on the one hand of the two refrigerating fluids (nitrogen and residual gas), and on the other hand of the calorigenic air to be treated, maintains both ends of the exchanger 1 at predetermined temperatures, for example of the order of +15° C. for the hot end with a temperature gap of about 5° C. between the outgoing and ingoing fluids, and of the order of −170° to −180° C. for the cold end, with a temperature gap of about 10° C. between the ingoing and outgoing fluids.

When the production of nitrogen is interrupted, the stop valves 5 and 8 are closed and valve 15 is opened. Thus, a controlled flow of cold gaseous nitrogen is sent to all the ducts of refrigerating fluids, while a flow of heat at room temperature reaches all the ducts of the exchanger at its hot end, via supports 11.

Thus, with a very low consumption of nitrogen, it is possible to maintain a temperature gradient relatively close to that corresponding to the normal operation of the plant, between the hot end and the cold end of the exchanger, during the rest periods of the plant. This expression should be understood in a broad sense as designating a temperature gradient between a cryogenic temperature, for example of the order of −110° C., for the cold end, and a temperature close to room temperature, for example of the order of +5° C., for the hot end.

It is thus possible to prevent thermal shocks when restarting the plant, and at the same time to decrease the required time for restarting to reach a normal equilibrium of the exchanger. Moreover, heat losses are reduced because of the permanent maintenance of cold conditions at the cold end of the exchanger.

As indicated in mixed line in FIG. 1, as a variant, the exchanger 1 may be provided with additional ducts especially adapted for the circulation of evaporations from the supply 13 during periods of rest. In this case, duct 14 directly ends into an inlet box 3A, adjacent box 3, which opens into these additional ducts.

Figure 2:
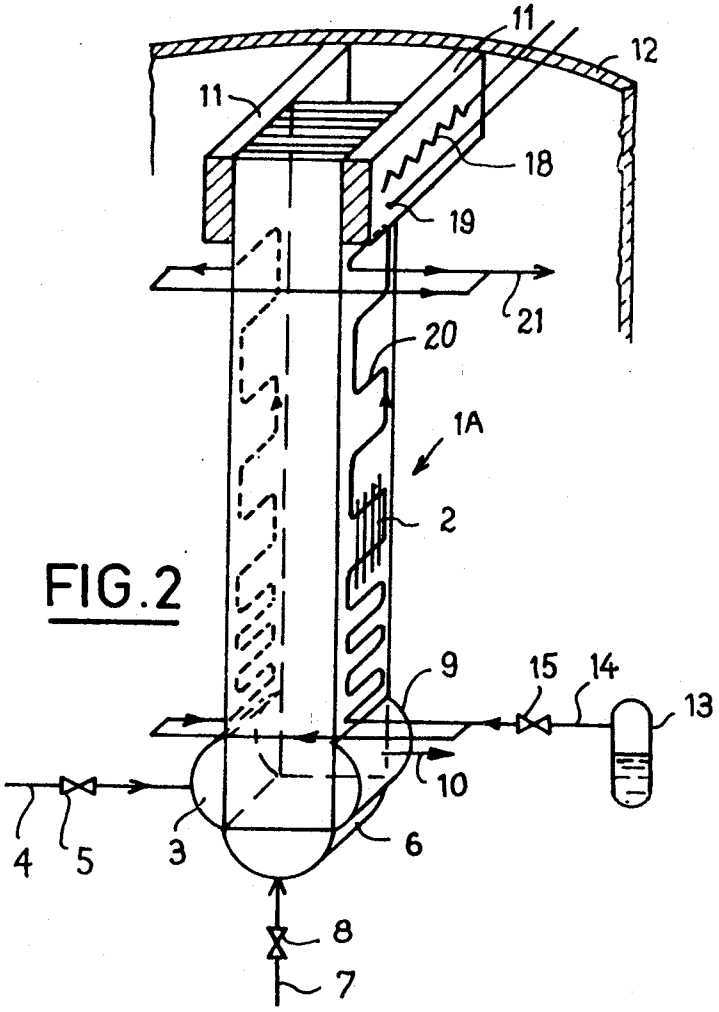
FIG. 2 is a similar view of another embodiment of heat exchanger according to the invention.

The embodiment illustrated in FIG. 2 differs from the previous by the following points.

On the one hand, at the hot end of the heat exchanger 1A, the supports 11 are provided with electrical resistances 18 which enable to bring a controlled addition of heat at this hot end, therefore maintaining the latter at a predetermined temperature which is near room temperature. For this purpose, the electrical current is sent in these resistances under the control of temperature probes 19 associated with each support 11.

On the other hand, the evaporations from the reserve of liquid nitrogen 13 are brought by means of duct 14, no more into boxes 3 and 6 or 3A, but in added coils 20 mounted in heat exchange relationship on the two opposite vertical faces of the exchanger containing boxes 3 and 9.

The two coils 20 are arranged in zig-zag, on the entire width of said faces, with a tight pitch in the cold zone of the exchanger, where the largest cold input is required, and a progressively increasing pitch while going up along the exchanger, to their exit, near supports 11, which is connected to a common duct 21 for the evacuation of reheated nitrogen.

Coils 20 are fixed on the exchanger so as to be in heat contact with all the ducts of the exchanger. This mounting may advantageously be mixed and may include a mechanical fixing means and a gluing by means of a suitable heat conductive cryogenic resin.

It should be noted that the exchanger 1 or 1A may be mounted either in a known cold box at atmospheric pressure or in certain plants, in a space under vacuum, which inter alia, is delimited by exterior wall 12.

As a variant, another way of keeping a temperature gradient in the exchanger 1A of FIG. 2 during periods when the apparatus is not in operation, is to provide a constant electrical power at the hot end by means of said resistances 18, to send the evaporations from tank 13 to the cold end of the exchanger and to control the temperature of the hot end through the flow rate of the evaporations from the tank. Thus, the evaporations from tank 13 are sent into the exchanger (valve 15 opened) when the temperature at the hot end is higher than an upper limit (such as 10° C.), and they are stopped (valve 15 closed) when the temperature at the hot end becomes lower than a lower limit (such as 0° C). Under the effect of the heat flow sent to the hot end, the temperature of the hot end rises again and, when it is higher than the upper limit, the evaporations from the tank are again introduced into the exchanger.

We claim:

1. Process for operating a heat exchanger which is part of a plant for the batch treatment of fluids, in which during active periods which are separated from one another by rest periods, at least one refrigerating fluid is allowed to circulate in first ducts of the exchanger, from the cold end to the hot end of the latter, and at least one calorigenic fluid circulates in second ducts of the exchanger, from the hot end to the cold end of the latter, wherein during rest periods, heat is introduced at the hot end and cold is introduced at the cold end of the exchanger so as to keep these two ends at temperatures which are relatively close to those corresponding to the active periods, at least one of these two inputs being supplied by means of a reserve fluid of the plant.

2. Process according to claim 1, wherein at the end of each rest period, said quantities of heat and/or cold are progressively increased to progressively bring the temperatures of the two ends of the exchanger to temperatures corresponding to the active periods.

3. Process according to claim 1, in which, during the active periods, one of the two ends of the exchanger is at a temperature near room temperature, wherein this end of the exchanger is placed in heat exchange relationship with outer atmosphere during the rest periods.

4. Process according to claim 1, for a cryogenic plant, wherein the hot end is placed in heat exchange relationship with outside atmosphere, by conduction, and the cold end is placed in heat exchange relationship with evaporations from a reserve cryogenic fluid of the plant.

5. Process according to claim 4, wherein during the rest periods, an additional quantity of heat is brought to the hot end.

6. Process according to claim 5, wherein said additional quantity of heat is constant, and the circulation of said evaporations is carried out when the temperature at the hot end exceeds an upper limit and is interrupted when it becomes below a lower limit.

7. Process according to claim 5, which comprises circulating said evaporations from the cold end to the hot end of the exchanger, through said second ducts of the exchanger.

8. Process according to claim 5, wherein said additional quantity of heat is provided by the Joule effect.

9. Process according to claim 5, which comprises circulating said evaporations from the cold end to the hot end of the heat exchanger through ducts especially provided for this purpose.

* * * * *